US011021837B2

(12) United States Patent
Bellm et al.

(10) Patent No.: US 11,021,837 B2
(45) Date of Patent: Jun. 1, 2021

(54) TUMBLE DRYER AND METHOD FOR DRYING LAUNDRY USING A TUMBLE DRYER

(71) Applicant: E.G.O. Elektro-Geraetebau GmbH, Oberderdingen (DE)

(72) Inventors: Mathias Bellm, Ubstadt-Weiher (DE); Rebecca Grill, Oberderdingen (DE); Uwe Schaumann, Oberderdingen (DE); Kay Schmidt, Oberderdingen-Flehingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 19 days.

(21) Appl. No.: 16/525,712

(22) Filed: Jul. 30, 2019

(65) Prior Publication Data

US 2020/0040515 A1 Feb. 6, 2020

(30) Foreign Application Priority Data

Aug. 6, 2018 (DE) ..... 10 2018 213 108.2

(51) Int. Cl.
*D06F 58/30* (2020.01)
*D06F 58/26* (2006.01)
(Continued)

(52) U.S. Cl.
CPC ..... *D06F 58/30* (2020.02); *D06F 58/26* (2013.01); *D06F 58/38* (2020.02);
(Continued)

(58) Field of Classification Search
CPC ..... D06F 58/26; D06F 58/30; D06F 58/38; D06F 2105/28; D06F 2103/36; D06F 2013/08
(Continued)

(56) References Cited

U.S. PATENT DOCUMENTS 4,231,166 A * 11/1980 McMillan ..... D06F 58/30 34/553
4,621,438 A * 11/1986 Lanciaux ..... D06F 58/06 34/77
(Continued)

FOREIGN PATENT DOCUMENTS

DE 4243594 A1 7/1993
DE 102009026646 A1 12/2010
(Continued)

OTHER PUBLICATIONS

European Search Report for Euruopean Patent Application No. 19186484.2, dated Nov. 29, 2019, (15 pages), European Patent Office, Munchen, Germany.
(Continued)

*Primary Examiner* — Stephen M Gravini
(74) *Attorney, Agent, or Firm* — Alston & Bird LLP

(57) ABSTRACT

A tumble dryer has a drum for laundry, a drive motor for the drum, an air supply to the drum and an air discharge from the drum, a fan, including a fan drive, for generating an air stream to the drum through the air supply and away from the drum through the air discharge, and also heating means for heating the air stream. The temperature of and the moisture in the air which is discharged from the drum are detected. The profile of said temperature and moisture is compared with prespecification curves, which are stored in a memory, for the profile of said temperature and moisture by means of calculation means depending on the drying phase of the laundry. The operating point of the prespecification curve at which the drying program is located is determined in this way. The control arrangement influences the further drying program, on the basis of the operating point, by way of adjusting the temperature and/or the intensity of the air stream.

22 Claims, 3 Drawing Sheets

(51) Int. Cl.

| | |
|---|---|
| ***D06F 58/38*** | (2020.01) |
| ***D06F 103/08*** | (2020.01) |
| ***D06F 103/36*** | (2020.01) |
| ***D06F 105/24*** | (2020.01) |
| ***D06F 105/28*** | (2020.01) |

(52) U.S. Cl.
CPC ..... *D06F 2103/08* (2020.02); *D06F 2103/36* (2020.02); *D06F 2105/24* (2020.02); *D06F 2105/28* (2020.02)

(58) Field of Classification Search
USPC ..... 34/499, 595–610
See application file for complete search history.

(56) References Cited

U.S. PATENT DOCUMENTS

| | | | | |
|---|---|---|---|---|
| 5,347,727 | A | 9/1994 | Kim | |
| 5,649,372 | A | 7/1997 | Souza | |
| 5,682,684 | A * | 11/1997 | Wentzlaff | D06F 58/30 34/495 |
| 6,047,486 | A * | 4/2000 | Reck | D06F 34/28 34/491 |
| 7,005,618 | B2 * | 2/2006 | Riddle | D06F 58/30 219/497 |
| 7,062,863 | B2 * | 6/2006 | Chung | D06F 25/00 34/596 |
| 8,276,293 | B2 * | 10/2012 | Ricklefs | D06F 58/203 34/595 |
| 8,863,400 | B2 * | 10/2014 | Ahn | D06F 58/02 34/74 |
| 9,255,358 | B2 * | 2/2016 | Kim | D06F 58/24 |
| 9,644,310 | B2 * | 5/2017 | Cimetta | D06F 58/20 |
| 9,745,690 | B2 * | 8/2017 | Lee | D06F 58/30 |
| 10,214,850 | B2 * | 2/2019 | Santillan Galvan | D06F 58/30 |
| 10,323,351 | B2 | 6/2019 | Weiss et al. | |
| 10,487,443 | B1 * | 11/2019 | D'Anna | F26B 3/343 |
| 2007/0033829 | A1 | 2/2007 | Kim | |
| 2007/0144035 | A1 * | 6/2007 | Choi | D06F 93/00 34/524 |
| 2013/0145644 | A1 * | 6/2013 | Moschutz | D06F 25/00 34/427 |
| 2013/0257331 | A1 | 10/2013 | Takada | |
| 2018/0282934 | A1 * | 10/2018 | Kamii | D06F 58/30 |
| 2019/0330790 | A1 * | 10/2019 | Ko | D06F 58/38 |
| 2020/0040515 | A1 * | 2/2020 | Bellm | D06F 58/20 |
| 2020/0087843 | A1 * | 3/2020 | D'Anna | D06F 58/266 |

FOREIGN PATENT DOCUMENTS

| | | | | |
|---|---|---|---|---|
| DE | 102015217667 | A1 | 3/2017 | |
| DE | 102016110859 | B3 | 6/2017 | |
| DE | 102016110871 | A1 | 11/2017 | |
| DE | 102016110883 | A1 | 11/2017 | |
| DE | 102017210527 | A1 | 12/2018 | |
| DE | 102018213108 | A1 * | 2/2020 | D06F 58/20 |
| EP | 0240052 | A1 | 10/1987 | |
| EP | 262018 | A1 | 3/1988 | |
| EP | 3067459 | A1 | 9/2016 | |
| EP | 3246454 | A1 | 11/2017 | |
| EP | 3608469 | A3 * | 5/2020 | D06F 58/30 |
| JP | 2013-022225 | A | 2/2013 | |
| KR | 100710215 | B1 * | 4/2007 | D06F 58/30 |
| WO | WO-2006011765 | A1 * | 2/2006 | D06F 93/00 |
| WO | WO-2016/170880 | A1 | 10/2016 | |

OTHER PUBLICATIONS

German Patent and Trade Mark Office, Search Report for German Application No. 102018213108.2, dated Apr. 30, 2019, (7 pages), München, Germany.

* cited by examiner

TUMBLE DRYER AND METHOD FOR DRYING LAUNDRY USING A TUMBLE DRYER

CROSS-REFERENCE TO RELATED APPLICATIONS

This application claims priority to German Application No. 10 2018 213 108.2, filed Aug. 6, 2018, the contents of which are hereby incorporated herein in its entirety by reference.

BACKGROUND

The invention relates to a tumble dryer and to a method for drying laundry, which is to be dried, using a tumble dryer.

Various types of tumble dryer are known, wherein a tumble dryer very commonly has a drum, together with a drive, an air supply and an air discharge. A fan is also provided in order to blow heated air into the tumble dryer via the air supply. Moisture is then removed from air which is discharged from the drum at the air discharge in different ways. In order to dry laundry, the same amount of heat or air of the same temperature is often always introduced into the drum. Moisture measurement takes place either in the drum or in the air which is discharged from the drum. If a specific desired degree of drying is identified, it is defined that the end of the drying program has been reached, and the dryer is stopped.

Various dryers, including those with inductive heating, are known from DE 10 2016 110 871 A1, EP 262 018 A2, EP 240 052 A1, DE 10 2016 110 883 A1, DE 10 2009 026 646 A1 and DE 10 2016 110 859 A1.

BRIEF SUMMARY

The invention is based on the problem of providing a tumble dryer of the kind mentioned in the introductory part and also a method of the kind mentioned in the introductory part, with which tumble dryer and method problems of the prior art can be solved and, in particular, it is possible to dry laundry quickly and efficiently and such that laundry is treated as gently as possible.

This problem is solved by a tumble dryer having the features of claim 1 and also by a method having the features of claim 18. Advantageous and preferred refinements of the invention are the subject matter of the further claims and will be explained in greater detail in the text which follows. In the process, some of the features will be described only for the tumble dryer or only for the method. However, irrespective of this, they are intended to be autonomously and independently applicable both to the tumble dryer and also to the method. The wording of the claims is incorporated in the content of the description by express reference.

A tumble dryer according to the invention has a drum in order to hold laundry which is to be dried, and also has a drive motor for the drum. An air discharge to the drum and also an air discharge away from the drum are provided. These are advantageously ducts with a large cross section, as is customary per se. A fan for generating an air stream is provided in order to move the air stream to the drum through the air supply. In this case, the same fan draws off air out of the drum or away from the drum through said air discharge. The fan has a dedicated fan drive which, in principle, can be of a very general nature.

Furthermore, heating means for heating the air stream are provided, this being essential for the drying function. Temperature detection means are provided in order to detect the temperature of the air which is supplied to the drum or, as an alternative, the air which is discharged from the drum. Provision can also be made to detect the temperature of the air in both cases. Moisture detection means are also provided in order correspondingly to detect moisture in the air which is supplied to the drum and/or the air which is discharged from the drum. The moisture in air which is discharged from the drum is advantageously measured in all cases in order to in this way acquire information about how much moisture there still is in the drum or how wet the laundry still is. The temperature can be detected in a similar way.

The tumble dryer has a control arrangement which firstly has a memory in which at least one prespecification curve for the profile of temperature and/or moisture with respect to time for a specific drying program for laundry is stored. This drying program can be matched to the type of laundry or to the principal fiber content of said laundry and also to a user requirement in respect of whether drying should be performed gently or quickly. Secondly, the control arrangement also has calculation means which are designed to compare, during a drying program, currently detected values for temperature and/or moisture with an abovementioned prespecification curve depending on the drying phase of the laundry during said drying program. Therefore, it is possible to determine the operating point of the prespecification curve at which the drying program is located. The currently detected values for temperature and/or moisture are now used for this purpose. Either only one prespecification curve is provided, in which case the operating point can be directly determined within this prespecification curve, or, as an alternative, a plurality of different prespecification curves can also be provided for this specific drying program, for example depending on the loading quantity. The most suitable prespecification curve can then likewise be ascertained by comparison with the detected values, and then the operating point can be determined within this prespecification curve.

The control arrangement is designed for influencing the further drying program or the further drying method, on the basis of the determined operating point. In particular, said further drying program can be optimized in the process, for which purpose the air stream can be adjusted or changed by influencing the heating means. In addition or as an alternative, the intensity of the air stream can be adjusted by influencing the fan, that is to say air can be supplied to the drum or blown into said drum more intensely or less intensely.

The control arrangement can also cause a drum movement or control the drive motor for the drum separately and as desired. Therefore, a said method for ascertaining the temperature of and/or the moisture in the laundry can be assisted in an optimum manner by adjusting the drum movement.

In particular, it is therefore possible to use the invention to influence the drying program in respect of temperature and/or intensity of the air stream in the further course, in order to advantageously reduce the temperature of the air stream to the drum to below the average for the temperature of the air stream used up until this point during the period of the last quarter of the drying program. To this end, it is now important to know the operating point of the prespecification curve at which the drying program is located. The temperature can particularly advantageously be reduced at least to 5° C., possibly even reduced at least to 15° C. to 20° C., below this average. Furthermore, the intensity of the air stream to the drum should be increased to above the average for the intensity of the air stream used up until this point, advantageously increased at least by 20%, particularly advantageously at least by 50%. Therefore, in this refinement of the invention, it is possible to implement the finding that a fair portion or large amount of the laundry is already dry and very warm in the outer region or in the outer layers during the last quarter of the drying program. Further or continued heating adds little or nothing to this, and therefore energy can be saved by reducing the temperature of the supplied air and, in addition, the laundry can be treated gently. Rather, the moisture is then discharged more effectively from the laundry which is intensely heated in any case by air being more intensively blown in at the end of the drying operation.

During the air drying process, the water or the moisture is evaporated from the laundry with the aid of warm, dry air. Said air is supplied and gives off heat to the laundry for the purpose of evaporating the moisture and, in the process, absorbs the moisture from the laundry. The moist air is then discharged.

Drying in the tumble dryer takes place predominantly by air drying. In the tumble dryer, the temperature, the air throughput and the drum movement are matched to one another such that a consistently good drying result is achieved. In addition, a contact drying process could possibly be provided, preferably by heating the drum.

In a further advantageous refinement of the invention, the intensity of the air stream can be reduced and, conversely, the temperature of said air stream can be increased at the beginning of the drying program, in particular during the first third or the first quarter of the estimated duration. Therefore, the laundry which is to be dried and which is still very wet or is almost at the initial moisture level, can be heated as rapidly as possible, so that the moisture can then be better evaporated at the surface of the material.

In order to achieve as good an effect as possible for the air supply, provision can be made for said air supply to be provided at most 10% of the diameter of the drum below the highest point of said drum. The air supply can advantageously be provided even at the highest point of the drum. This ensures that the air supply is not directly covered or unintentionally blocked by laundry. Furthermore, in the case that air is also drawn off at the air supply for the purpose of detecting the temperature of and/or the moisture in the air in the drum, said detection is impeded as little as possible by laundry which is located close to said air supply.

Specifically, in one refinement of the invention, it is possible for the fan direction or the direction of the air stream to be reversed several times at intervals. Air can then be drawn off from the drum into the air supply, specifically drawn off not at the air discharge but rather at the air supply. Information about the exhaust air or the air from the drum can be obtained in this way. Said information is particularly advantageously information relating to the temperature of and/or the moisture in the exhaust air which can be used for determining the operating point on a prespecification curve as mentioned above or for determining the prespecification curve itself. This is primarily advantageous when the temperature detection means and the moisture detection means in the air supply are arranged close to the drum. This will be explained in more detail below.

The fan is preferably arranged close to the drum. The distance can be at most 50 cm, preferably at most 30 cm or even only 20 cm, from the drum.

Whereas the fan is usually driven by the drum drive in the prior art and therefore, on account of a prespecified rotation speed of the drum which is always the same, the fan drive is also always the same, this preventing a variation in the intensity of the air stream, in an advantageous refinement of the present invention the fan drive is a dedicated drive which is provided only for the fan. The fan drive particularly advantageously forms one structural unit together with the fan. A suitable power electronics system, which can advantageously continuously adjust the fan drive, is provided for activating the fan drive. However, this is known in the prior art and is not a problem at all.

In an advantageous refinement of the invention, the fan has an inductively heatable fan rotor which therefore forms a heating means for heating the air stream for the drum. To this end, the fan rotor can have a plurality of fan blades, wherein at least one fan blade is at least partially composed of material which can be heated by means of a magnetic field generating means or contains a material of this kind. This material is preferably provided in a radially outer region of the fan rotor or of the fan blades, as a result of which it can be arranged as close as possible to said magnetic field generating means. Provision can be made for a fan blade to be formed entirely from a material of this kind. Therefore, in the event of inductive heating of this fan blade, the air conveyed by it can be heated as well as possible.

The magnetic field generating means are preferably arranged adjacent to the fan rotor and/or can at least partially surround said fan rotor. In this case, said magnetic field generating means can also be arranged in or on a fan housing. An example of an inductively heatable fan of this kind is known from DE 102017210527.5 from the same applicant with the application date Jun. 22, 2017. In an advantageous refinement of the invention, the at least one magnetic field generating means has at least one induction coil or is an induction coil of this kind. A single induction heating coil is advantageously provided for a fan. Depending on the design of the fan or fan rotor, said induction heating coil can be wound around the fan rotor radially outside the fan rotor, so that the coil axis of said induction heating coil coincides with the rotation axis of the fan rotor. As an alternative, a plurality of induction coils can be arranged adjacent to one another around the fan rotor, so that the coil axes of said induction coils run perpendicular to the axis of the fan rotor and face said axis.

In this case, it is advantageously possible for the temperature detection means to comprise the fan rotor and the magnetic field generating means in the form of the induction coil. The temperature of the inductively heatable fan blade or of the inductively heatable fan rotor, and therefore also the temperature of the air stream which is generated by the fan or the conveyed air, can be identified from the activation of the induction coil. An inductive temperature measurement of this kind is generally known to a person skilled in the art for induction heating arrangements, for example from the field of induction hobs together with induction heating coils. Therefore, firstly, the temperature of air which is blown into the drum can be detected for regulating the heating means at a desired temperature. Secondly, when the rotation direction of the fan rotor and of the air stream is reversed, the temperature of the air drawn off directly from the drum can be measured. Therefore, the temperature which prevails in the drum can be, to all intents and purposes, virtually directly detected.

Therefore, in this refinement, the heating means for heating the air stream can form the temperature detection means at the same time. Owing to the fan or the fan rotor being used for temperature measurement, a separate temperature sensor can be saved.

As an alternative, separate discrete temperature sensors can be provided, which are advantageously arranged in the air supply close to the drum, and therefore the temperature of the air can be measured as quickly as possible and immediately after being drawn off from the drum. However, these discrete temperature sensors can then also be provided at the air discharge from the drum close to the drum. In this case, any desired heating means can be provided in principle, and even inductive heating of the fan rotor in the above-described refinement can be provided by means of at least one permanent magnet. Said permanent magnet can be arranged, on its own or together with further permanent magnets, close to the fan rotor in a manner similar to the above-described induction coils for inductively heating the fan rotor. In this case, a complex induction generator for the abovementioned induction coils can be dispensed with, this considerably reducing the outlay on components.

In principle, a magnetic field generating means for an inductively heatable fan rotor can be arranged outside a fan housing or outside the air supply. Therefore, an air stream is adversely affected as little as possible.

A magnetic field generating means of this kind can run outside the fan rotor with a radial extent, preferably only axially level with the fan rotor and not above it or not below it.

In a further advantageous refinement of the invention, the moisture detection means mentioned in the introductory part can also be realized in or by the fan or comprise the fan and the drive of said fan. Specifically, the moisture in the conveyed air can be determined from the activation of the fan drive. In this case, use can be made of the situation that a high torque has to be provided by the drive when there is a high level of moisture in the air which is moved by the fan, whereas a lower torque has to be provided when there is a low level of moisture in the air which is moved by the fan. This is simply because the specific density is higher in the first case than in the second case, and therefore more power and, respectively, a higher torque is to be provided by the fan drive in the first case. During normal operation of the fan for conveying air into the drum via the air supply, detection of the moisture in the air of this kind is not necessary. In the case of, for example, a condensation dryer, the level of moisture is usually relatively low here. Rather, with this option, the moisture in the air which is drawn off from the drum should be detected during the abovementioned reversal of the fan direction or of the direction of the air stream. Since a dedicated fan drive, together with its own activation arrangement, is provided in any case, this can also be used as a moisture detection means at the same time. Separate moisture detection means can then be dispensed with. For the purpose of assessing whether a high or a low torque is to be provided by the fan drive, a phase shift between current and voltage in the fan drive is advantageously monitored. Therefore, the level of said torque can be determined, with this relationship being known to a person skilled in the art in principle.

As an alternative to detecting the moisture via the fan drive, a separate moisture detection means can be provided. Said moisture detection means can then be an independent moisture sensor. Similarly to the manner described above for the temperature sensor, said moisture sensor, when it is of independent design, can also be provided in the air discharge, where the moisture can then be detected during the normal air circulation with a normal fan direction.

In an advantageous refinement of the invention, the drum of the tumble dryer according to the invention is internally free of sensors. Therefore, said drum can be designed in a simplified manner with an increased degree of operational reliability since now no sensors can break down. The drum may possibly not have any sensors on its outer side either, as a result of which it can also be designed in a simple and reliable manner in this respect.

These and further features can be gathered not only from the claims but also from the description and the drawings, wherein the individual features can be realized in each case on their own or as a plurality in the form of subcombinations in an embodiment of the invention and in other fields, and can constitute embodiments which are advantageous and which are protectable per se and for which protection is claimed here. The subdivision of the application into individual sections and subheadings does not restrict the statements made under them in terms of their general validity.

BRIEF DESCRIPTION OF THE DRAWINGS

Exemplary embodiments of the invention are schematically illustrated in the drawings and will be explained in more detail below. In the drawings.

DETAILED DESCRIPTION

Figure 1:
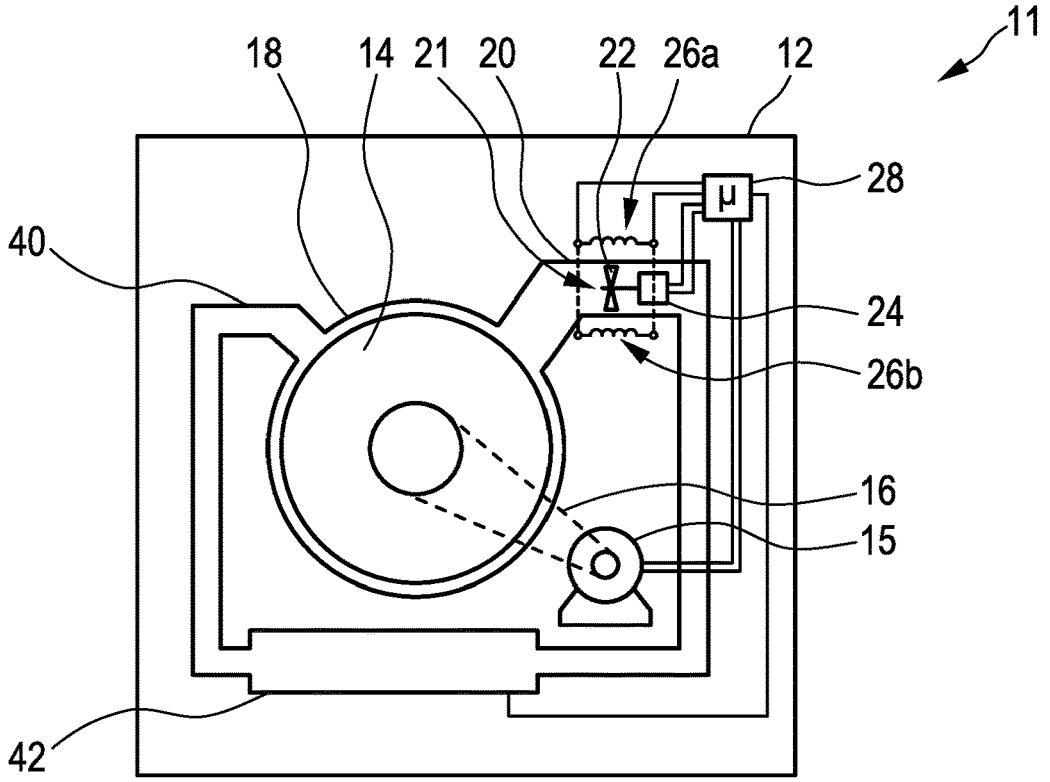
FIG. 1 shows a schematic illustration of a tumble dryer according to the invention comprising an inductively heated fan together with a separate fan drive.

FIG. 1 illustrates how a tumble dryer 11 according to the invention can be constructed in principle. The tumble dryer 11 has a housing 12 with a drum 14 which is arranged in a drum holder 18. The drum 14 can be driven by a drum drive 15 by means of a drive belt 16, as is known in principle. In this case, the drum 14 usually revolves at a single possible revolution speed which then also remains constant. However, this can also be varied. In this case, the drum 14 does not have any sensors or the like at all, in particular none for temperature or moisture.

A duct-like air supply 20 extends to the top right of the drum holder 18, as is known per se from the prior art. This high position is important and advantageous, as has been explained above. A fan 21 together with a fan rotor 22 and a fan drive 24, advantageously as one structural unit, are arranged in the air supply 20. The fan rotor 22 is, as has been explained in the introductory part, composed of inductively heatable material, primarily the individual rotor blades are composed of said material. Therefore, said fan rotor can be inductively heated by two induction coils 26*a* and 26*b* which are arranged outside the air supply 20 opposite the fan rotor 22 and such that they surround said fan rotor. This is also known from the prior art. The heating can be varied depending on the strength of the magnetic field which is generated by the induction coils 26*a* and 26*b* and also depending on the rotation speed of the fan rotor 22. A fan 21 of this kind, which can be inductively heated, is well known.

The drum drive 15, the fan drive 24 and the induction coils 26*a* and 26*b* are connected to a control arrangement 28 of the tumble dryer 11. Said control arrangement carries out the method explained in the introductory part and also the rest of the operation of the tumble dryer. The control arrangement 28 advantageously has an appropriately designed processor.

In addition, an air discharge 40 is also arranged at the top left of the drum holder 18, which air discharge leads to a condenser 42 by way of water being separated off in a known manner from the moist air which is drawn off from the drum 14. It can be seen that the drum 14, the air discharge 40 and the air supply 20 form a kind of circuit, wherein the air in said circuit is moved or circulated in the counterclockwise direction to all intents and purposes. This air flow direction corresponds to that during the normal conventional drying operation. Instead of the condenser 42 in the air discharge 40, the tumble dryer 11 can also utilize a heat pump or remove moisture in some other way from the air which is drawn off from the drum 14 at the air discharge 40.

The control arrangement 28 is designed to ascertain the temperature of the fan rotor 22 and, respectively, of the inductively heatable parts which are present on said fan rotor on the basis of the activation of the induction coils 26*a* and 26*b*. Therefore, the temperature of air flowing past said fan rotor can be indirectly detected, this also being advantageous or even necessary during normal heating operation. Furthermore, the control arrangement 28 activates the fan drive 24 of the fan 21, so that said control arrangement knows or can ascertain the power to be applied by said fan. As has been explained in the introductory part, conclusions can be drawn about the moisture in the transported air as a result. Finally, the control arrangement 28 can advantageously contain a converter or inverter for the fan drive 24 or can be designed as one structural unit with said converter or inverter. Similarly, said control arrangement can have an induction generator or form one structural unit with said induction generator for the purpose of activating the induction coils 26*a* and 26*b*. Therefore, in one refinement of the invention, a central control unit could be provided, which central control unit performs the abovementioned control functions and power supply.

Figure 2:
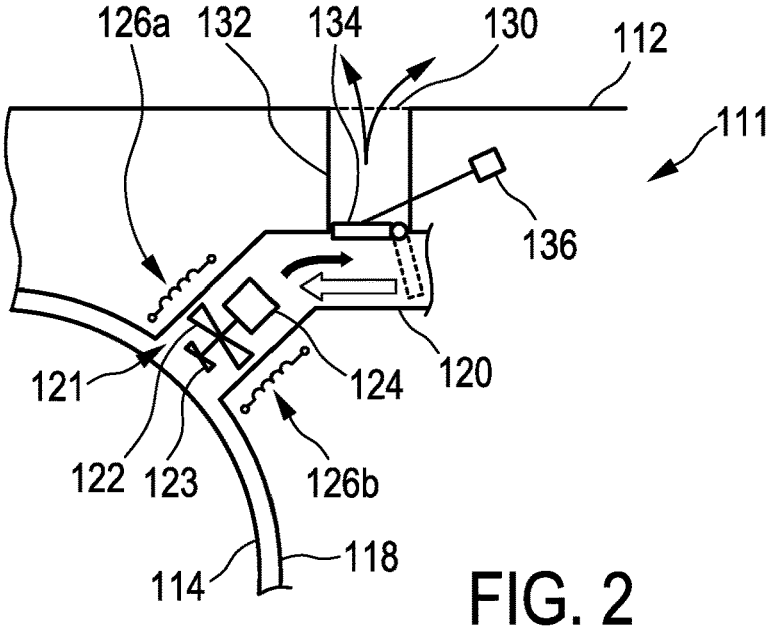
FIG. 2 shows an enlarged illustration of an alternative refinement of an air supply with a branch to a separate outlet out of a housing.

The control arrangement can also be a combination of an inverter and a controller or microcontroller and measuring means, for example a current measuring coil or a current shunt. A zero crossing identification can also be provided. FIG. 2 illustrates an enlargement of an alternative tumble dryer 111 as a variant which has an additional outlet 130 in its housing 112. This outlet 130 issues at a branch 132 which extends from the air supply 120 or is connected to said air supply at the top. Said outlet is closed off by a branch valve 134 which can be opened in the downward direction and closed in the upward direction, that is to say can be moved, by a valve actuator 136. The valve actuator 136 can be a rod-type drive, or alternatively an electromagnet or the like.

A relatively small second fan rotor 123 is fastened to a fan 121 on the same shaft on which a relatively large first fan rotor 122 is also seated. The second fan rotor 123 is designed for conveying air in the opposite rotation direction to the first fan rotor 122. That is to say, if the fan drive 124 rotates in its normal direction, the first fan rotor 122 conveys air through the air supply 120 in accordance with the large arrow into the drum holder 118 and therefore also into the drum 114 in line with normal operation. Said fan rotor can be heated in the above-described manner by induction coils 126*a* and 126*b* in order to thereby heat the conveyed air for the operation of the dryer. The second fan rotor 123 can likewise be partially or entirely composed of inductively heatable material. If, specifically, the fan drive 124 rotates in the opposite rotation direction for which the second fan rotor 123 is designed, the air stream is generated in line with the relatively thin arrow and air is drawn off from the drum 114 into the air supply 120. When the branch valve 134, illustrated in dashed lines, is open in the downward direction, said air flows upward through the outlet 130, here out of the housing 112 by way of example. As an alternative, said air could also be guided back into the duct of the air discharge 40 via a return, as a result of which the escape of lint can be reduced or avoided. This air from the drum 114 naturally does not have to be heated; in this case, the heating function provided by means of the induction coils 126*a* and 126*b* serves to detect the temperature of this drawn-off air in this way. As explained in the introductory part, this is done on the basis of the operating values of the induction coils 126*a* and 126*b*. The first fan rotor 122 may have no effect in this second opposite conveying direction; it may possibly contribute to conveying air in this direction, but this is not necessary. Finally, the second fan rotor 123 is provided for this purpose.

If, in line with FIG. 1, only one single fan rotor 22 is provided on the fan 21, said fan rotor should be designed for operation in both directions. A considerably improved degree of efficiency can be provided for blowing air into the drum 14 through the air supply 20, but this should also be possible, at least in principle, in the other direction. The fan 21 or 121 can be operated as desired and autonomously by the fan drive 24 or 124 which is independent of the drum drive 15 in each case.

The process of drawing off air from the drum 114 for detecting the temperature of this air does not have to last for long; for example, it can be provided only for 2 seconds to 10 seconds.

At the same time as the temperature of the drawn-off or discharged air from the drum 114 is detected, the instantaneous power of the fan drive 124 can also be detected in general by monitoring the fan drive 124 and its operating values. As has already been explained above, the moisture in the drawn-off air and therefore within the drum 114 can be determined from said instantaneous power. The more power the fan drive 124 has to apply for the drawing-off process at a specific rotation speed, the more moisture this air contains. The laundry in the drum 114 then also contains more moisture.

Determining the moisture in the air which is discharged from the drum, possibly also in the air which is supplied to the drum 114, advantageously takes place by means of determining a phase shift in the fan drive 124 since the torque required changes with the dependency of the viscosity of the air on its moisture content. Air with a high moisture content is simply more difficult to convey than dry air. A corresponding reference in the control arrangement or a preceding "calibration" in dry air allows this determination. A measurement of this kind can be readily carried out in the dual fan 121 illustrated in FIG. 2. In this case, the difference between drawing off the air from the drum 114 and blowing air into the drum is measured. Useful information about this process can be obtained from the difference.

Heating the air by means of the inductively heated fan rotor 22 and, respectively, 122 or 123 allows evaluation of the energy, which is absorbed by the induction coils 126*a* and 126*b*, in parallel. The profile of the absorbed energy can be identified by way of corresponding control variables on an induction generator, not illustrated, this providing information about the temperature of the fan rotors since comparison with existing characteristic curves is possible.

Dynamic electromagnetic excitation of the induction coils 126*a* and 126*b* can provide further information about the temperature of the air. If regulation to the energy input or the power output to the induction coils 126*a* and 126*b* is performed with the objective of not heating the air, but rather of keeping the fan rotor at the temperature of the conveyed air, the change in comparison to known characteristic curves can then also provide an indication of the moisture in the air or the change in said moisture.

The combination of the two items of information relating to detecting the moisture and the temperature allows a process to be conducted independently of a direct temperature measurement since known characteristic values can be recorded and compared with those currently existing in the process. Therefore, process-oriented regulation to the parameters moisture and ideal air temperature is possible. Known parameters such as external temperature and pressure, which can be measured by sensors here, can additionally assist in the regulation operation. In particular, the influences of the laundry, which are very random on account of the different composition of said laundry, can be more quickly identified since further parameters such as drum movement and therefore laundry movement can be included in the evaluation of the measurement results.

Figure 3:
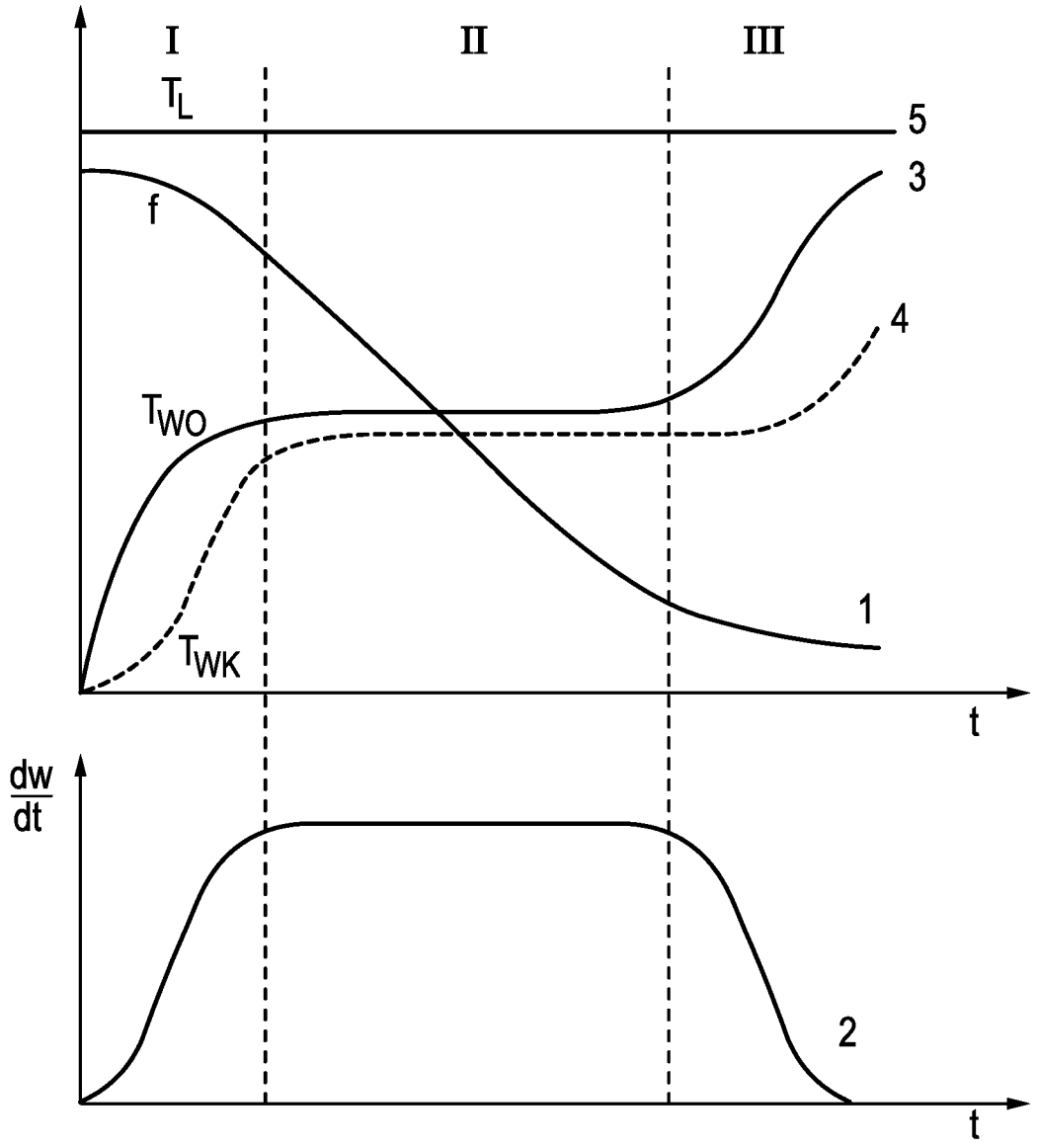
FIG. 3 shows an illustration of profiles of drying parameters with respect to time.

FIG. 3 illustrates various profiles of parameters with respect to time t. The profile 1 is the relative moisture in the laundry. The parameter 2 in the graph illustrated below is the mass flow of the moisture which has been removed, indicated in kg/(m$^2$s). The parameter of the profile 3 is the surface temperature $T_{WO}$ of the laundry. The profile 4 of the corresponding parameter shows the core temperature $T_{WK}$ of the laundry, and the profile 5 is the temperature $T_L$ of the supplied air. All temperatures are indicated in ° C.

In section I, heating of the laundry and evaporation of the moisture takes place at the surface of the material. The drying intensity is not high since, firstly, the transferred heat is required not only for evaporating the moisture but rather, primarily, also for heating all the laundry. Secondly, the thermal moisture conductivity which increases owing to the temperature difference between the surface and the core slows down the removal of the moisture.

A definition of the thermal moisture conductivity is such that the moisture content of the laundry continuously changes during drying. This creates a concentration gradient between the surface of the textile, from which moisture is continually removed, and the inner layers of the items of laundry, said concentration gradient consequently causing the transportation of moisture from locations of relatively high moisture concentration to locations of low moisture concentration in line with moisture diffusion, also called moisture conductivity. The moisture is therefore transported to the surface of the laundry or to the location of the evaporation boundary, converted into vapor there, said vapor being mixed with the heated air, and discharged to the surrounding area. In the process, the evaporation boundary moves over the course of the drying process or drying program from the surface of the laundry into the interior of the laundry.

Since heat is supplied for the evaporation process, the material which is to be dried is also heated in addition to the moisture being removed. The supply of heat over the surface creates a temperature difference between the surface and the inner layers or the core.

On account of effects which are linked to the bonding of liquids into capillaries, moisture has the tendency to migrate from locations of relatively high temperature to locations of relatively low temperature. This phenomenon is called thermal moisture. If the surface temperature is greater than the core temperature, the vectors of the moisture conductivity and the thermal moisture conductivity have different mathematical signs, that is to say the drying process slows down. The influence of the thermal moisture conductivity falls as the product to be dried increasingly heats through as a reduction in the temperature gradient. The temperature difference over the cross section of the laundry also reduces as the laundry increasingly heats up, this leading to an increase in the drying speed.

In section II, the drying speed is constant. The temperature of the surface and of inner layers or the core differ only slightly and are subject only to small changes. A stationary state is established, the influence of the thermal moisture conductivity lapses and the drying process is determined solely by the moisture conductivity.

In section III, the drying speed drops again. The evaporation boundary moves as heating increases from the surface to the inner layers or the core of the laundry. The heat which is supplied by means of the air is no longer used only or predominantly for evaporating the moisture, but rather increasingly for heating the laundry. In section III, the partial pressure difference between the inner and outer layers of the laundry is critical for the transportation of moisture to the surface of the laundry. At the end of section III, removal of the moisture from the laundry is terminated, and the temperature of the laundry approaches the temperature of the air. Overall, the drying speed depends on the conditions of the heat transfer at the surface of the laundry and the distance of the water vapor from the evaporation boundary.

Figure 4:
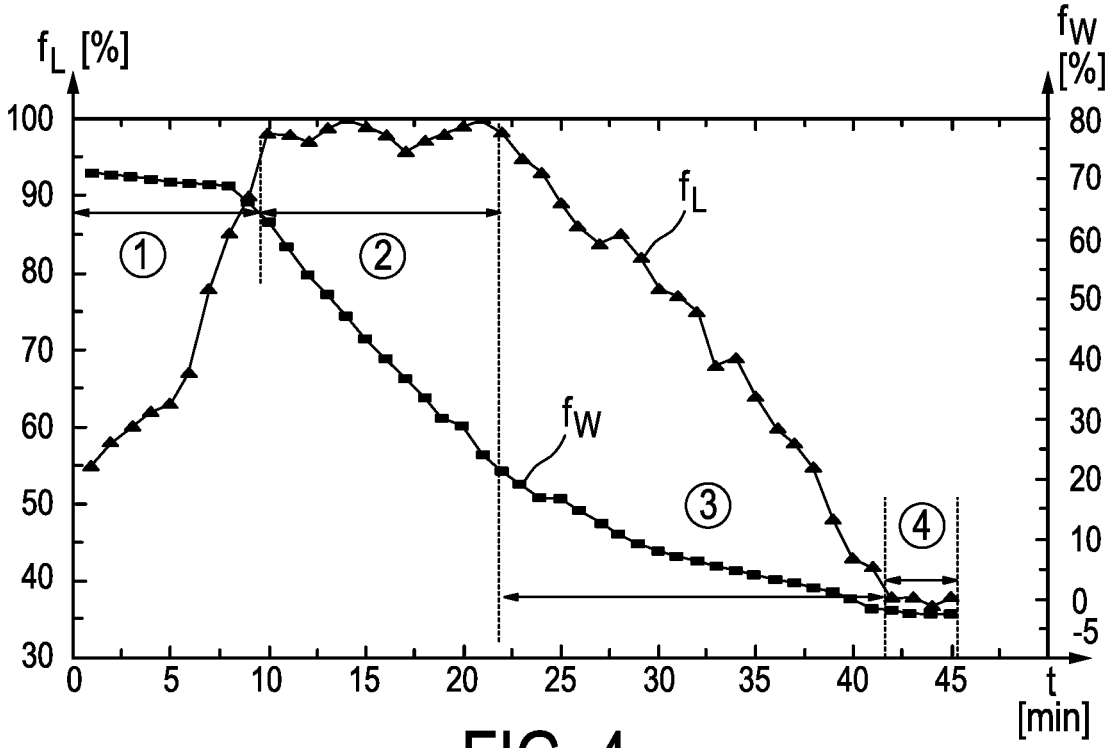
FIG. 4 shows an illustration of profiles of the moisture in the air and in the laundry with respect to time with four phases.

In FIG. 4, triangles mark the time profile of the moisture $f_L$ in the air as has been measured during a drying process. During phase 1 for the first 9 minutes, this moisture in the air rises sharply to almost 100%. It remains at this high value during phase 2 for approximately a further 12 minutes. During phase 1, the time profile of the moisture $f_W$ of the laundry, which is marked by rectangles, drops only slightly. This moisture $f_W$ in the laundry has been determined experimentally for the same time and cannot be directly detected with the tumble dryer according to FIG. 1 or FIG. 2. During phase 2, the moisture $f_W$ in the laundry drops sharply, this not being surprising since the air which is discharged during this phase is saturated to the maximum or almost to the maximum, see the moisture $f_L$.

In following phase 3 which lasts for approximately 20 minutes, the moisture $f_W$ is still dropping, but this drop flattens out. Accordingly, the moisture $f_L$ also drops sharply. During the last phase 4 which lasts for approximately 5 minutes, hardly any more moisture can be discharged into the air, but the laundry is dry or completely dry since the moisture $f_W$ in said laundry has reached zero or is even slightly below zero.

Figure 5:
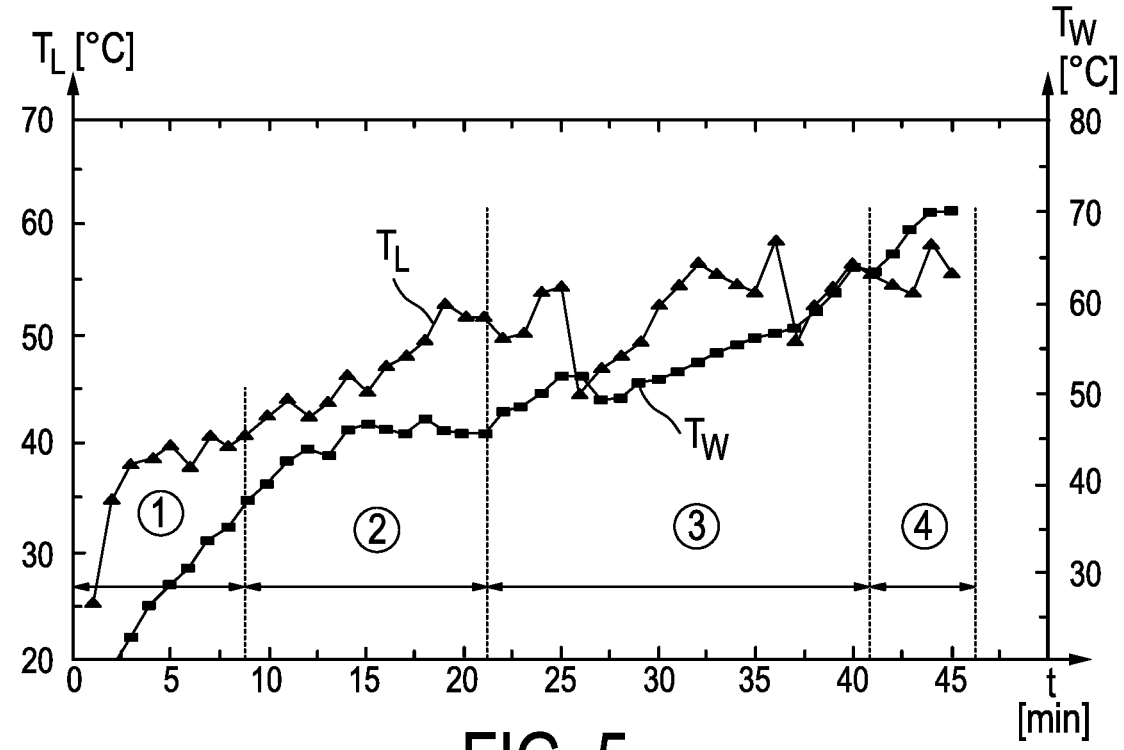
FIG. 5 shows an illustration of profiles of the temperature of the air which is introduced into a drum of the tumble dryer and of the laundry with respect to time with four phases.

In FIG. 5, in a manner split into the four phases in line with FIG. 4, a profile for the temperature $T_L$ of the discharged air is illustrated using triangles during the same drying process. Similarly, a profile for the temperature $T_W$ of the laundry is illustrated using rectangles. Said profile corresponds approximately to the core temperature $T_{WK}$ of the profile 4 in FIG. 3. The temperature $T_W$ of the laundry, like the moisture $f_W$ in the laundry previously, has been determined experimentally.

It can be seen that, in phase 1, the temperature $T_L$ is quickly increased to approximately 40° C. In phase 2, the temperature $T_L$ is once again increased to somewhat above 50° C. However, in phase 1, the temperature of the laundry $T_W$, which is illustrated using rectangles, increases in a somewhat delayed manner. A temperature increase is then sharply reduced during phase 2.

It is only at the beginning of phase 3, when the temperature $T_L$ has also been increased to a certain extent, that the temperature $T_W$ once again increases slightly, with two short drops, even though the temperature $T_L$ has corresponding dips.

In the relatively short phase 4, the temperature $T_W$ even increases yet further, while the temperature $T_L$ is lower and, if anything, remains the same or even drops to a certain extent.

Both the theoretical examination and also the considerations on the basis of experiments suggest that the drying process can be optimized when the measurement of the parameters for the temperature and moisture is optimized.

Specifically, it is recommended to accelerate the process of increasing the temperature of the laundry in phase 1, so that the evaporation begins as quickly as possible. In phase 2, the temperature $T_W$ is equal to the temperature $T_L$, so that the supplied energy is utilized for the evaporation. In phase 3, an increase in the temperature $T_L$ is hardly expedient or not expedient at all since this only leads to an increase in the temperature $T_W$ and not to an acceleration of the evaporation on account of the thermodynamic effects. Phase 4 is necessary on account of the non-uniform moisture distribution which is more difficult to remove since it involves "bound moisture". The combination of heating power, air flow rate or convection and drum movement is critical here. The focus below is on heating power.

In respect of the four phases, the functioning is separated into:

heating up the laundry, constantly heating the laundry, constant drying phase without heat or with a small amount of heat, blowing air through the laundry without heat or with a small amount of heat.

If the existing heating systems are used, an improvement can then be achieved by means of the regulation and control.

In parallel, a combination of an air heating system with an integrated heating arrangement in the fan allows optimization of the measurement function with fewer components and increased data detection. The objective here is to utilize indirect information from the process for the process. Ultimately, parameters which have a direct relationship to convection and evaporation of water in the dryer should be directly detected and used for regulating the process. Owing to said possibility of controlling the drum movement or the drive motor for the drum as desired, a mentioned method for detecting parameters can be assisted in an optimum manner for regulation of the process.

Therefore, it is possible to not necessarily replace existing sensors but to add to them. Above all, attempts can be made to dispense with sensors in the drum itself since these are difficult to fit and to evaluate.

With the knowledge of these profiles with respect to time in line with FIGS. 3 to 5, it is possible, by way of detecting the temperature of and the moisture in the air in the drum, which can be performed in the drum without sensors according to the invention, to draw conclusions about the point of a profile of this kind at which the drying process is located. Said drying process can then be optimized, in particular in respect of the temperature $T_L$ no longer having to be so high toward the end. Therefore, energy can be saved and the laundry which is to be dried can also be treated gently. As a result, it is possible to improve drying of laundry using a tumble dryer, in particular the above-described tumble dryer according to the invention.

The invention claimed is:

1. Tumble dryer comprising:

a drum for holding laundry which is to be dried, a drive motor for said drum, an air supply to said drum, an air discharge from said drum, a fan for generating an air stream to said drum through said air supply and away from said drum through said air discharge, a fan drive for said fan, heating means for heating said air stream, temperature detection means for detecting a temperature of air which is supplied to said drum or air which is discharged from said drum, moisture detection means for detecting a moisture in said air which is supplied to said drum or said air which is discharged from said drum, a control arrangement comprising:

a memory, wherein at least one prespecification curve for a profile of temperature or moisture with respect to time for a specific drying program for laundry is stored in said memory, calculation means, wherein said calculation means are designed to compare currently detected values for said temperature or said moisture with a prespecification curve depending on a drying phase of said laundry during a drying program and to determine an operating point of said prespecification curve at which said drying program is located, wherein said control arrangement is designed for influencing a further drying program, on a basis of said operating point, by way of adjusting said temperature of said air stream by influencing said heating means and/or by way of adjusting an intensity of said air stream by influencing said fan.

2. Tumble dryer according to claim 1, wherein said air supply is provided at most 10% below a highest point of said drum.

3. Tumble dryer according to claim 2, wherein said air supply is provided above said highest point of said drum.

4. Tumble dryer according to claim 1, wherein said fan is at most 50 cm away from said drum.

5. Tumble dryer according to claim 1, wherein said fan drive is a dedicated drive only for said fan, wherein said fan drive is designed as one structural unit together with said fan.

6. Tumble dryer according to claim 1, wherein said fan has an inductively heatable fan rotor as heating means, wherein said fan rotor has a plurality of fan blades, wherein at least one of said fan blades is at least partially composed of, or contains, a material which can be heated by means of a magnetic field generating means.

7. Tumble dryer according to claim 6, wherein said at least one magnetic field generating means is arranged adjacent to said fan rotor or at least partially surrounds said fan rotor and is arranged on a fan housing of said fan.

8. Tumble dryer according to claim 7, wherein said at least one magnetic field generating means has or is at least one induction coil, wherein said temperature detection means comprise said fan rotor and said magnetic field generating means as an induction coil.

9. Tumble dryer according to claim 8, wherein said temperature of said air which is discharged from or supplied to said drum can be determined from an activation of said induction coil.

10. Tumble dryer according to claim 7, wherein said at least one magnetic field generating means has at least one permanent magnet.

11. Tumble dryer according to claim 6, wherein said at least one magnetic field generating means is arranged outside a fan housing or outside said air supply.

12. Tumble dryer according to claim 6, wherein said at least one magnetic field generating means runs outside said fan rotor with a radial extent.

13. Tumble dryer according to claim 12, wherein said at least one magnetic field generating means is arranged radially outside said fan rotor and in an encircling manner as an induction coil with a coil center axis which runs parallel to a rotation axis of said fan rotor or coincides with said rotation axis of said fan rotor.

14. Tumble dryer according to claim 1, wherein said moisture detection means comprise said fan and, respectively, a fan drive, wherein a level of said moisture can be determined from an activation of said fan drive of said fan in such a way that a high torque is to be provided by said drive when there is a high level of said moisture in said air which is moved by said and a low torque is to be provided by said fan drive when there is a low level of said moisture in said air which is conveyed by said fan.

15. Tumble dryer according to claim 14, wherein said level of said moisture can be determined by monitoring a phase shift between current and voltage in said fan drive.

16. Tumble dryer according to claim 1, wherein said drum is internally free of sensors.

17. Tumble dryer according to claim 16, wherein said drum does not have any sensors on an outer side either.

18. Method for drying laundry, which is to be dried, using a tumble dryer, wherein said tumble dryer has:

a drum for holding laundry which is to be dried, a drive motor for said drum, an air supply to said drum, an air discharge from said drum, a fan for generating an air stream to said drum through said air supply and away from said drum through said air discharge, a fan drive for said fan, heating means for heating said air stream, temperature detection means for detecting a temperature of said air which is supplied to said drum or said air which is discharged from said drum, moisture detection means for detecting a moisture in said air which is supplied to said drum or said air which is discharged from said drum, a control arrangement comprising:

a memory in which at least one prespecification curve for a profile of said temperature or said moisture with respect to time for a specific drying program for laundry is stored, calculation means in order to compare currently detected values for said temperature or said moisture with a prespecification curve during a drying program and in order to determine an operating point of said prespecification curve at which said drying program is located, the method comprising the steps of:

detecting current values for said temperature and/or said moisture during a drying program, comparing said current values for said temperature and/or said moisture with a prespecification curve, determining said operating point of the prespecification curve at which said drying program is located on a basis of said comparison, influencing a further drying program on a basis of said operating point, in terms of adjusting said temperature of said air stream by influencing said heating means or in terms of adjusting an intensity of said air stream by influencing said fan.

19. Method according to claim 18, wherein said further drying program is influenced in terms of said temperature or said intensity of said air stream, wherein then:

said temperature of said air stream to said drum is at least 5° C. below an average for said temperature of said air stream used up until this point, said intensity of said air stream to said drum is at least 20% above said average for said intensity of said air stream used up until this point.

20. Method according to claim 18, wherein said further drying program, primarily during a period of a last quarter of said drying program, is influenced in terms of said temperature or an intensity of said air stream.

21. Method according to claim 19, wherein a fan direction and, respectively, a direction of said air stream is reversed several times at intervals in order to then draw off said air from said drum into said air supply in order to acquire information about said exhaust air in this way.

22. Method according to claim 21, wherein information relates to said temperature of or said moisture in said exhaust air.

* * * * *